United States Patent [19]

Sekiya

[11] Patent Number: 4,839,996

[45] Date of Patent: Jun. 20, 1989

[54] METHOD AND APPARATUS FOR MACHINING HARD, BRITTLE AND DIFFICULTLY-MACHINABLE WORKPIECES

[75] Inventor: Shinji Sekiya, Tokyo, Japan

[73] Assignee: Disco Abrasive Systems, Ltd., Tokyo, Japan

[21] Appl. No.: 118,133

[22] Filed: Nov. 9, 1987

[51] Int. Cl.[4] ..... B24B 1/00

[52] U.S. Cl. ..... 51/281 R; 51/74 R; 51/283 R

[58] Field of Search ..... 51/72 R, 74 R, 92 R, 51/281 R, 283 R

[56] References Cited

U.S. PATENT DOCUMENTS

| | | | |
|---|---|---|---|
| 3,177,624 | 4/1965 | Highberg | 51/283 |
| 3,513,821 | 5/1970 | Bouvier . | |
| 3,715,787 | 2/1973 | Hudson . | |
| 4,576,139 | 3/1986 | Cogswell | 51/74 R |

FOREIGN PATENT DOCUMENTS 3416441 11/1985 Fed. Rep. of Germany .

39395 11/1960 Luxembourg .

OTHER PUBLICATIONS

Werkstatt & Betrieb, vol. 120, No. 4, Apr. 1987, pp. 303–307, Carl Hanser Verlag, Munich, DE; K. Dittmann et al.: "Hochgeschwindigkeitsschleifen—Möglichkeit zur Produktivitätssteigerung bei der Matallbearbeitung" *p. 303, col. 1, paragraph 1*.

Patent Abstracts of Japan, vol. 7, No. 246 (M-253)[1391], Nov. 2nd, 1983; & JP-A-58 132 447 (Nihon Gaishi K.K.) 06-08-1983, *Abstract; figure*.

*Primary Examiner*—Rodney B. Bovernick
*Assistant Examiner*—Jay Ryan
*Attorney, Agent, or Firm*—Beveridge, DeGrandi & Weilacher

[57] ABSTRACT

Machining of a hard, brittle and difficultly-machinable workpiece by a grinding wheel made of superabrasive grains. The grinding wheel is rotated at a peripheral speed of 1000 to 5500 m/min., and the grinding wheel and the workpiece are moved relative to each other in the machining direction at a feed speed of at least 30 mm/sec.

1 Claim, 2 Drawing Sheets

METHOD AND APPARATUS FOR MACHINING HARD, BRITTLE AND DIFFICULTLY-MACHINABLE WORKPIECES

BACKGROUND OF THE INVENTION

1. Field of the Invention

This invention relates to a method and an apparatus for machining a hard, brittle and fifficultly-machinable workpiece with a grinding wheel made of superabrasive grains.

The term "grinding wheel made of superabrasive grains", as used in the present specification and the appended claims, means a circular or annular rotating abrasive wheel made by bonding superabrasive grains such as natural or synthetic diamond abrasive grains or cubic boron nitride abrasive grains. The term "hard, brittle and difficultly-machinable workpiece", as used herein, means a work piece which is generally machined by using a grinding wheel made of superabrasive grains, for example a ferrite or ceramic workpiece.

2. Description of the Prior Art

As is well known, in the machining of a hard, brittle and difficultly-machinable workpiece, for example in a fluting operation in the manufacture of reading magnetic heads by providing a number of grooves in nearly rectangular ferrite blocks, a grinding wheel made of superabrasive grains and the workpiece are moved relatively to each other in a predetermined machining direction.

In conventional machining operations, the relative feed speed of the workpiece and the grinding wheel should be maintained extremely low in order to perform good machining as one desires without causing "chipping" to the workpiece and breakage to the grinding wheel. In fact, as far as the present inventor knows, the above relative speed feed in conventional machining operations is 17 mm/second at the highest. Hence, the conventional machining operations take a considerably long time.

SUMMARY OF THE INVENTION

The present invention has been accomplished in view of the above-described fact. It is an object of this invention to provide a novel and excellent machining method and apparatus which permits good machining as one desires at a much higher relative feed speed than conventional relative feed speeds without giving rise to problems such as chipping in the workpiece and breakage in the grinding wheel.

The present inventor has extensively conducted research and experimental work on the machining of hard, brittle and difficultly-machinable workpieces by a grinding wheel made of superabrasive grains. This work has unexpectedly led to the discovery that in order to increase the relative feed speed greatly, it is critical to limit the peripheral speed of the grinding wheel to a predetermined range, and in other words, the relative feed speed cannot be greatly increased when the peripheral speed of the grinding wheel is too low or too high.

On the basis of the above-mentioned requirement discovered by the present inventor, the present invention provides a method of machining a hard, brittle and difficultly-machinable workpiece by a grinding wheel made of superabrasive grains, wherein the peripheral speed of the grinding wheel is limited to 1000 to 5500 m/min., and the grinding wheel and the workpiece are moved relative to each other in the machining direction at a feed speed of at least 30 mm/sec.

As a machining apparatus for achieving the above object, the present invention provides a machining apparatus comprising a chuck table for holding a hard, brittle difficultly-machinable workpiece, a rotatably mounted grinding wheel made of superabrasive grains, rotating means capable of rotating the grinding wheel at a peripheral speed of 1000 to 5500 m/min., and moving means for moving the chuck table and the grinding wheel relative to each other in the machining direction at a feed speed of at least 30 mm/sec.

In a pareferred embodiment of this invention, the peripheral speed of the grinding wheel is 2000 to 5000 m/min., and the feed speed is at least 50 mm/sec.

DETAILED DESCRIPTION OF THE PREFERRED EMBODIMENT

The invention will now be described in detail with reference to the accompanying drawings.

Figure 1:
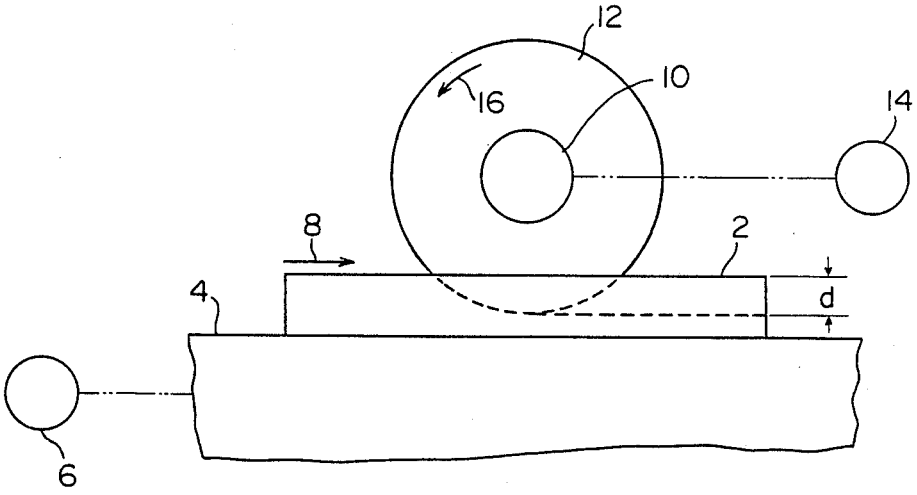
FIG. 1 is a simplified side view showing one mode of the method of this invention.

With reference to FIG. 1, a hard, brittle and difficultly-machinable workpiece 2 (which may be of ferrite or various ceramics) to be machined is fixedly secured and held by a suitable method such as magnetic attraction or vacuum chucking onto a chuck table 4 mounted movable in the left-right direction. A driving source 6 which may be an electric motor is drivingly connected to the table 4. The driving source 6 constitutes moving means. Upon energization of the driving source 6, the table 4 and the workpiece 2 fixedly secured thereto are moved in the direction shown by an arrow 8 (or in an opposite direction).

Above the table 4, a shaft 10 extending in a direction perpendicular to the sheet surface in FIG. 1 is rotatably mounted on a suitable supporting structure (not shown). A circular grinding wheel 12 made of superabrasive grains is fixed to one end portion of the shaft 10. The grinding wheel 12 may be of any known type produced by bonding superabrasive grains such as natural or synthetic diamond abrasive grains or cubic boron nitride abrasive grains by a suitable method such as a metal bond method or a resin bond method. A driving source 14 which may be an electric motor is drivingly connected to the shaft 10. This driving source 14 constitutes rotating means for rotating the grinding wheel. Upon energization of the driving source 14, the grinding wheel 12 is rotated in the direction shown by an arrow 16.

To provide a groove having a depth of d and extending in the left-right direction by machining the upper part of the workpiece 2, the relative height of the shaft 10 and the table 4 is adjusted so that the grinding wheel 12 interferes with the workpiece 2 from its upper surface to a predetermined cut depth d. The driving source 14 is energized to rotate the grinding wheel 12 in the direction of arrow 16, and the driving source 6 is energized to move the table 4 and the workpiece 2 secured to its upper surface in the direction of arrow 8. As a result, a groove is formed in the workpiece 2 by the machining action of the grinding wheel 12 as the workpiece 2 is fed (FIG. 1 shows an intermediate stage of this fluting operation). If desired, instead of, or in addition to, feeding the workpiece 2, the shaft 10 and the grinding wheel 12 fixed to it may be moved in a direction opposite to the direction of arrow 8.

In the above machining, let the force required to machine the workpiece 2 by the grinding wheel 12, i.e. the rotating resistance exerted on the grinding wheel 12 from the workpiece 2, be F and the peripheral speed of the grinding wheel 12 be V. If any effect by the feeding movement is ignored, the power $P_1$ consumed in the machining of the workpiece 2 by the grinding wheel can be expressed as $P_1=F\times V$. Hence, the driving source 14 should impart power $P_2$ exceeding the power $P_1$ to the grinding wheel 12.

The present inventor thought that the power $P_3$ obtained by subtracting the consumed power $P_1$ determined by ignoring any effect of the feeding movement from the power $P_2$ actually applied initially to the grinding wheel $(P_2-P_1)$ is consumed owing to the feeding movement during machining, and therefore the machining efficiency can be increased by simply increasing the power (horsepower) of the driving source 14 and thus increasing the relative feed speed.

It was found, however, as can be understood from experiments described hereinafter, that the relative feed speed cannot be increased sufficiently by simply increasing the power of the driving source, and that to increase the relative feed speed sufficiently, it is critical to limit the peripheral speed of the grinding wheel to a predetermined range. More specifically, the present inventor has found that in order to obtain a feed speed of 30 mm/sec. which is about 1.8 times the highest feed speed (17 mm/sec.) in conventional machining operations, it is critical to limit the peripheral speed of the grinding wheel 12 to 1000 to 5500 m/sec.; and that to obtain a feed speed of 50 mm/sec. which is about 2.9 times the highest feed speed (17 mm/sec) in conventional machining operations, it is critical to limit the peripheral speed of the grinding wheel to 2000 to 5000 m/min. It has also been confirmed that this phenomenon remains basically the same irrespective of changes in cut depth and thickness, the material of which the workpiece 2 is made and the material of which the grinding wheel is made. It seems that when the peripheral speed of the grinding wheel 12 decreases, the consumed power $p_1$ $(=F\times V)$ determined by ignoring any effect of the feeding movement decreases and the feed speed can be increased. Actually, however, when the feed speed is increased by decreasing the peripheral speed of the grinding wheel 12 below the above-mentioned required values, chipping occurs in the workpiece 2 or breakage occurs in the grinding wheel 12. Although no clear reason can be assigned to it, the inventor presumes it to be due to the unique machining behavior of the grinding wheel by which the workpiece 2 is machined while causing ultrafine breakage of the grinding wheel 12 itself. On the other hand, even when the feed speed is increased by increasing the peripheral speed of the grinding wheel above the above-mentioned required values, chipping occurs in the workpiece 2 or the grinding wheel 12 breaks. No clear reason can be assigned to it, either. The inventor presumes that in addition to the above unique machining behavior of the grinding wheel 12, when the peripheral speed of the grinding wheel 12 becomes too high, cooling water to be impinged against the peripheral edge portion of the grinding wheel for cooling fails to collide sufficiently with the grinding wheel 12 owing to the cetrifugal force and an air current formed near the grinding wheel by the centrifugal force, and that consequently, the cooling effect of the water is reduced.

EXPERIMENTAL EXAMPLE

According to the mode shown in FIG. 1, a groove with a depth of 9.0 mm was formed by machining a polycrystalline ferrite workpiece having a longitudinal (machining direction) size of 40 mm, a lateral size of 20 mm and a thickness of 10 mm. The grinding wheel used is a grinding wheel sold under the tradename "AIAI-RO3" by Disco Abrasive Systems, Ltd. which was produced by bonding synthetic diamond abrasive grains by a metal bond method. The grinding wheel had a diameter of 101.6 mm (4 inches) and a thickness of 0.5 mm. During machining, tap water was impinged against the machining part of the grinding wheel at a rate of 7.0 liters/min.

Figure 2:
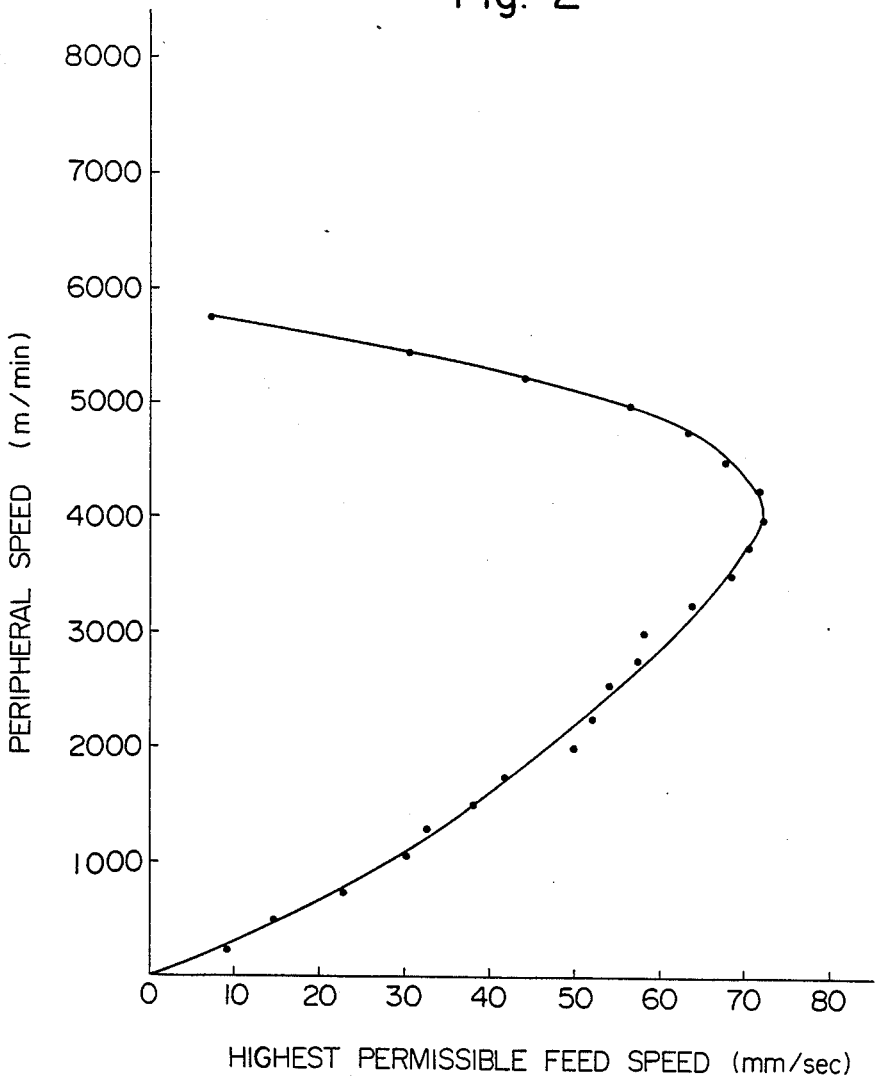
FIG. 2 is a diagram showing the relation between the peripheral speed of the grinding wheel and the highest permissible relative moving speed in Experimental Example given hereinbelow.

FIG. 2 is a diagram showing the relation between the peripheral speeds shown in Table 1 on the ordinate and the highest permissible feed speeds in Table 1 on the abscissa. It is understood from FIG. 2 taken in conjunction with Table 1 that when the peripheral speed of the grinding wheel is adjusted to 1000 to 5500 m/min., the feed speed can be increased to 30 mm/sec. which is about 1.8 times the highest feed speed (17 mm/sec.) in conventional machining operations, or higher, and when the peripheral speed of the grinding wheel is adjusted to 2000 to 5000 m/min., the feed speed can be increased to 50 mm/sec., which is about 2.9 times the highest conventional feed speed (17 mm/sec.), or higher.

TABLE 1

| Peripheral Speed (m/min.) | Highest permissible feed speed (mm/sec.) |
|---|---|
| 250 | 8 |
| 500 | 14 |
| 750 | 22 |
| 1000 | 31 |
| 1250 | 33 |
| 1500 | 38 |
| 1750 | 42 |
| 2000 | 50 |
| 2250 | 52 |
| 2500 | 54 |
| 2750 | 56 |
| 3000 | 58 |
| 3250 | 64 |
| 3500 | 68 |
| 3750 | 70 |
| 4000 | 72 |
| 4250 | 71 |
| 4500 | 67 |
| 4750 | 63 |
| 5000 | 56 |
| 5250 | 44 |
| 5500 | 30 |
| 5750 | 7 |

The peripheral speed of the grinding wheel was changed from 250 m/min. to 5750 m/min. at intervals of 250 m/min. At each of these peripheral speeds, the feed speed of the workpiece was increased incrementally by 2/mm/sec, and the highest permissible feed speed was determined. The highest permissible feed speed is the feed speed at which spark occurred during machining. When the feed speed was increased beyond the speed at which spark occurred, chipping tended to occur in the groove formed in polycrystalline ferrite workpiece and the grinding wheel tended to break.

The highest permissible feed speeds at the various peripheral speed of the grinding wheel are shown in Table 1.

What is claimed is:

1. A method of machining a ferrite workpiece including the steps of providing a rotating grinding wheel made of diamond abrasive grains, rotating the grinding wheel at a peripheral velocity of 2,000 to 5,000 m/min., and providing relative movement between the grinding wheel and the ferrite workpiece in a machining direction, said relative movement being at a feed speed of at least 50 mm/sec.

* * * * *